US006099417A

United States Patent [19]

Brown et al.

[11] Patent Number: 6,099,417

[45] **Date of Patent: *Aug. 8, 2000**

[54] APPARATUS FOR TOSSING OR TEEING A BALL

[75] Inventors: Patrick Brown, Strongsville; G. Stewart Lenox, Akron; Paul Madan, University Heights; John Jeffrey Norton, Stow, all of Ohio

[73] Assignee: The Little Tikes Company, Hudson, Ohio

[ * ] Notice: This patent is subject to a terminal disclaimer.

[21] Appl. No.: 08/911,154

[22] Filed: Aug. 14, 1997

[51] Int. Cl.[7] ..... A63B 69/40

[52] U.S. Cl. ..... 473/417; 473/422

[58] Field of Search ..... 124/7, 36, 61, 124/50, 73, 41.1, 45; 92/134; D21/720; 273/387, 393, 398; 473/132, 134, 417, 422

[56] References Cited

U.S. PATENT DOCUMENTS

| | | | |
|---|---|---|---|
| D. 250,361 | 11/1978 | James . | |
| D. 281,891 | 12/1985 | Topp | D21/720 |
| D. 399,286 | 10/1998 | Brown et al. | D21/720 |
| 2,975,779 | 3/1961 | Pope . | |
| 3,545,752 | 12/1970 | Hill et al. | 124/16 |
| 3,664,670 | 5/1972 | Glass et al. | 124/16 X |
| 3,792,861 | 2/1974 | Coleman | 124/16 X |
| 3,856,300 | 12/1974 | Payne | 124/16 |
| 4,254,755 | 3/1981 | Morgan et al. | 124/16 |
| 4,368,885 | 1/1983 | Katada et al. | 124/16 X |
| 4,402,507 | 9/1983 | Hudson | 124/16 X |
| 4,575,080 | 3/1986 | Miles . | |
| 4,858,921 | 8/1989 | Eustice et al. . | |
| 4,865,318 | 9/1989 | Lehmann et al. | 124/16 |
| 5,207,421 | 5/1993 | Gorvin | 124/45 X |
| 5,221,081 | 6/1993 | Rooks . | |
| 5,590,876 | 1/1997 | Sejnowski | 473/417 |
| 5,597,160 | 1/1997 | Mims . | |
| 5,613,678 | 3/1997 | McKee et al. . | |
| 5,619,977 | 4/1997 | Gatin | 124/16 X |
| 5,800,288 | 9/1998 | Mims | 473/417 |

FOREIGN PATENT DOCUMENTS

| | | | |
|---|---|---|---|
| 542950 | 12/1955 | Belgium | 124/16 |

OTHER PUBLICATIONS

Playskool, Inc. "1–2–3 Baseball" advertisement, 1 page (1994).

Today's Kids "Pitch Hitter Baseball" assembly instructions, 4 pages (undated), admitted prior art.

Fisher–Price, Inc. "Baseball Training Center" instructions, 6 pages (1994).

*Primary Examiner*—Raleigh W. Chiu

*Attorney, Agent, or Firm*—Foley & Lardner

[57] ABSTRACT

A ball tossing or teeing device (20) includes a housing (21) which carries an operating mechanism (22). A pedal (30) is depressible to actuate the operating mechanism (22) such that upon a single depression and release of pedal (30), the operating mechanism (22) launches a ball and positions another ball in place for launching. A chute (24) can be attached to the housing (21) and carries a tee (25). When the chute (24) is attached to the housing (21), the ball will move up the chute (24) and be placed on the tee (25) upon activation of the operating mechanism (22).

29 Claims, 7 Drawing Sheets

APPARATUS FOR TOSSING OR TEEING A BALL

TECHNICAL FIELD

This invention relates to a device to assist children in developing their baseball skills. More particularly, this invention relates to a device which in one mode can be used to toss a ball upwardly and in another mode can be used to place a ball on a batting tee.

BACKGROUND ART

In order to promote the hand/eye coordination necessary to play the game of baseball, a number of devices are available for children to develop their baseball, particularly batting, skills. In the simplest form, batting tees are available whereby a ball is manually placed on the tee so that it is elevated above the ground at a height suitable for hitting.

For more advanced training, devices are available which project a ball into the air so that the child may learn to hit the moving target. In most such devices, a ball is placed on a projecting mechanism which is then activated to toss the ball generally vertically upward. There is a wide variety of known projecting mechanisms, such as pedal operated devices, air powered devices, and the like which can be quite complex and usually involve some type of time delay feature whereby the child can place the ball on the projecting mechanism and thereafter position himself to swing at the ball which is subsequently projected.

A few known devices provide combined teeing and tossing capabilities. One such device is shown in U.S. Pat. No. 5,590,876. In that device, a ball can be placed on a tee or projected through a launching tube which can be oriented at different angles. However, projecting a ball through a tube is problematic because the potential friction between the ball being projected and the tube can result in inconsistent tosses. Moreover, the operation of the device of this patent requires multiple manipulations. After a ball is manually positioned, one foot pedal is operated to cock the launching mechanism and then a pneumatically operated remote release pedal is activated to project the ball after a predetermined time delay. As such, this device is quite costly, complex and cumbersome to operate.

Thus, the need exists for a simple and economically manufactured device which can automatically load a ball onto a tee or toss a ball in one simple operation by the user.

DISCLOSURE OF THE INVENTION

It is thus an object of the present invention to provide a device which can selectively be used to either toss or tee a ball.

It is another object of the present invention to provide a device, as above, in which a ball is automatically fed to the tossing or teeing position.

It is a further object of the present invention to provide a device, as above, which is operated by a foot pedal such that in one operation of the foot pedal the device is cocked, the ball is released, and another ball is advanced into position for the next operation.

It is yet another object of the present invention to provide a device, as above, in which the tee may be positioned at selected locations.

It is an additional object of the present invention to provide a device, as above, which is inexpensive to manufacture and easy to use.

These and other objects of the present invention, as well as the advantages thereof over existing prior art forms, which will become apparent from the description to follow, are accomplished by the improvements hereinafter described and claimed.

In general, an apparatus for launching balls includes a housing which carries an operating mechanism. A pedal is depressible to actuate the operating mechanism such that upon a single depression and release of the pedal, the operating mechanism is actuated to launch a ball and to position another ball in place for launching.

In accordance with another aspect of the invention, the apparatus may be utilized as a ball teeing device. To that end, a chute may be attached to the housing, and a teeing assembly is carried by the chute. Upon activation of the operating mechanism, the ball will move up the chute and onto the teeing assembly.

A preferred exemplary ball tossing or teeing device incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
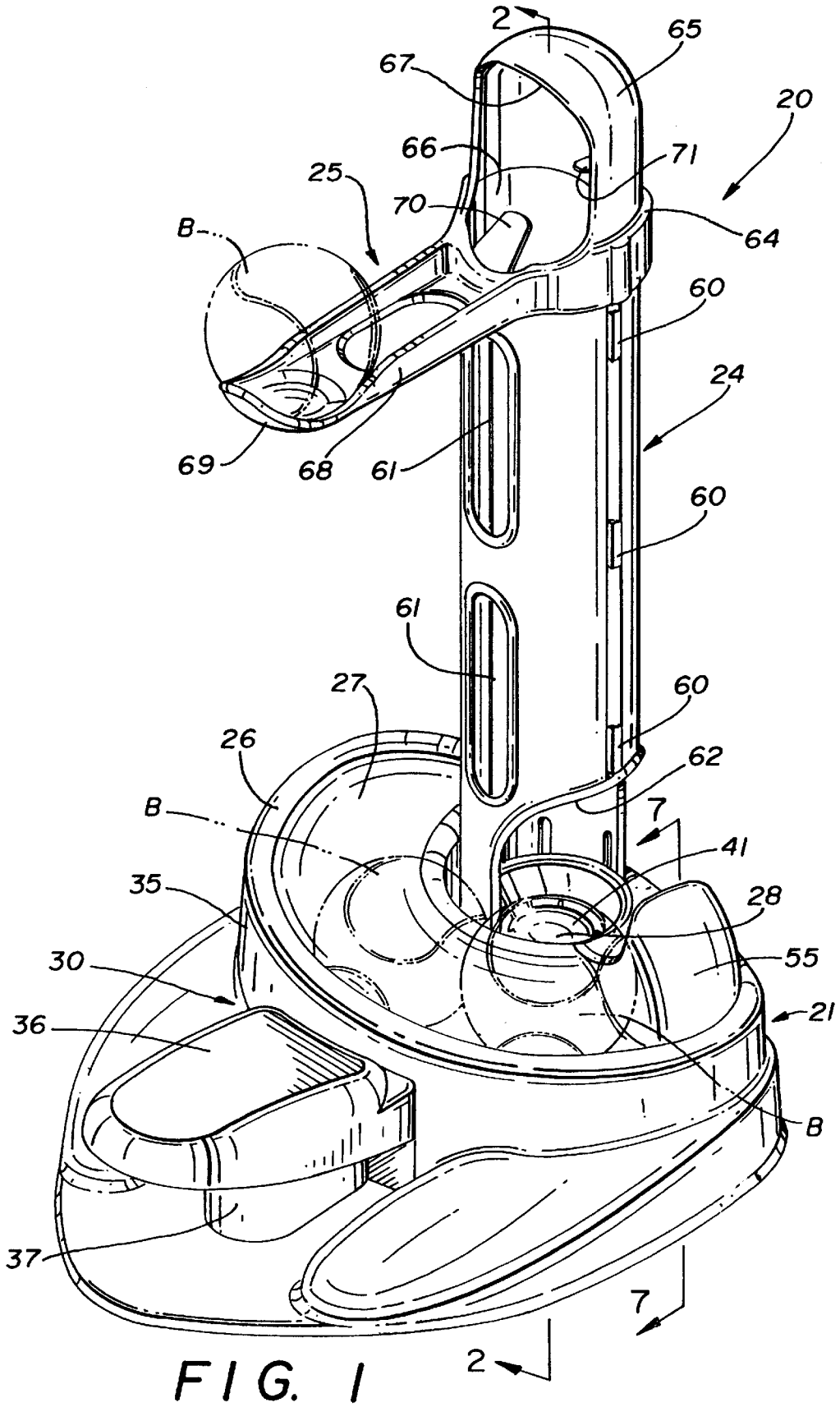
FIG. 1 is perspective view of a ball tossing or teeing device made in accordance with the present invention and showing the device in the ball teeing mode.
Figure 2:
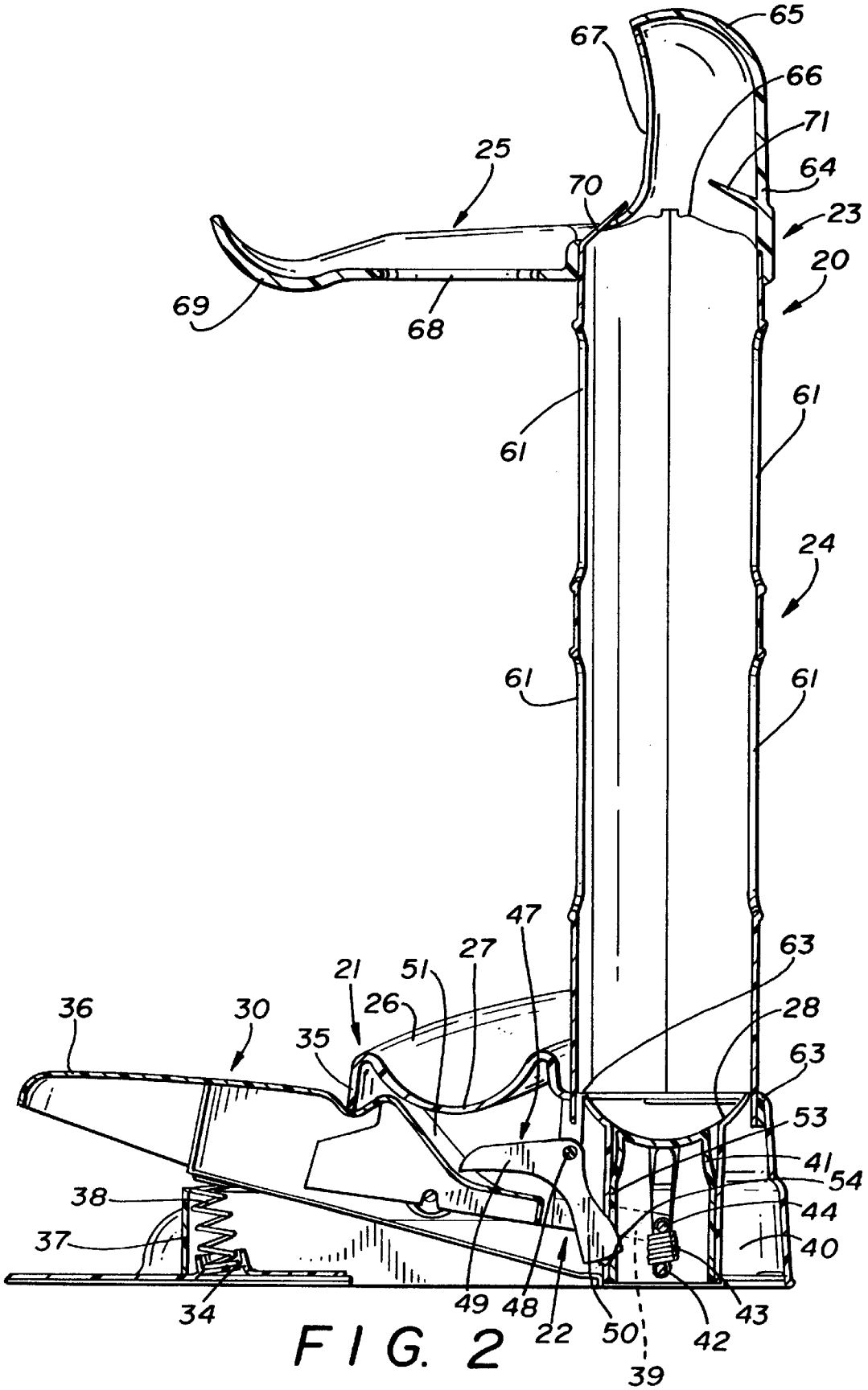
FIG. 2. is a sectional view taken substantially along line 2—2 of FIG. 1.
Figure 10:
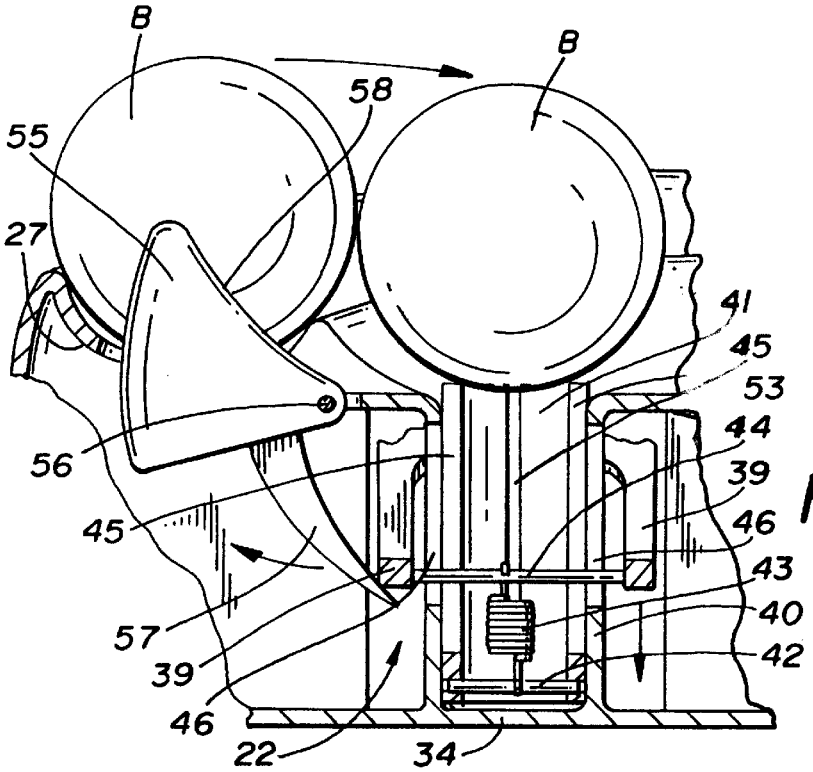
FIG. 10 is a somewhat schematic, fragmented, sectional view like FIG. 7 and sequentially following FIG. 9 in the operation of the device showing the operating mechanism in the same position as FIG. 6.
Figure 11:
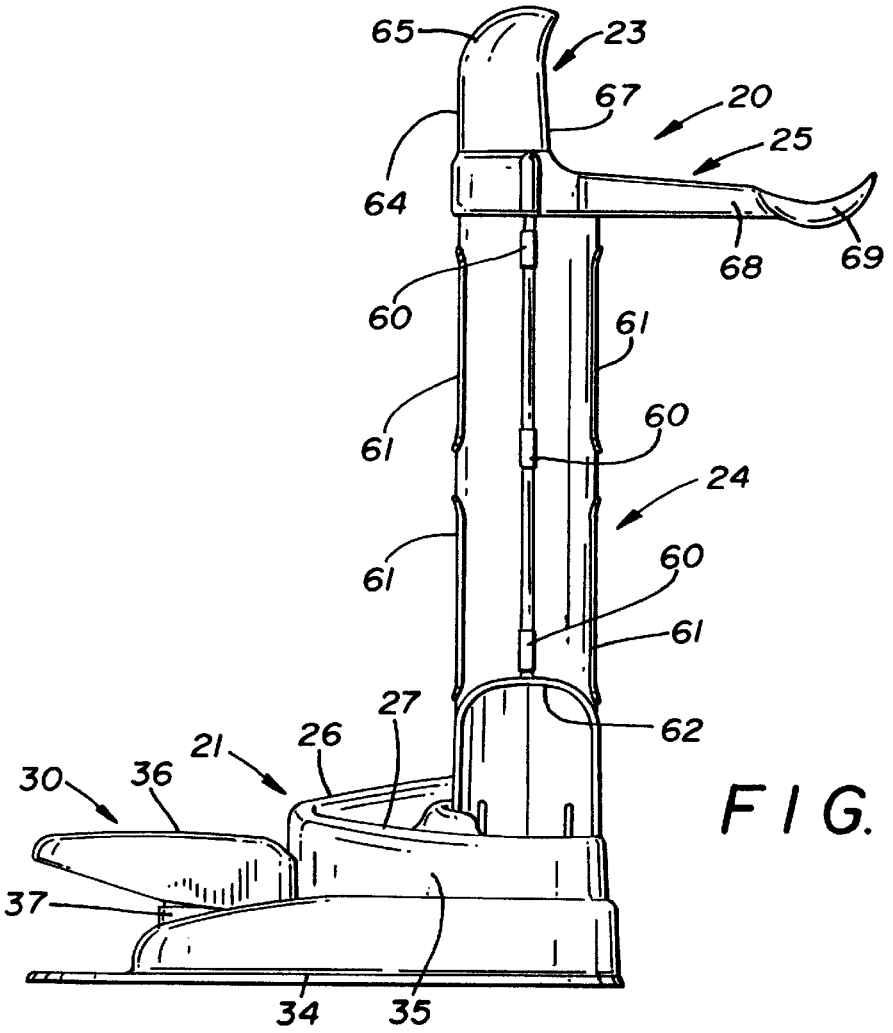
FIG. 11 is a side elevational view of the device shown in FIG. 1 but showing the tee in a position 180 degrees of the position in FIG. 1.
Figure 12:
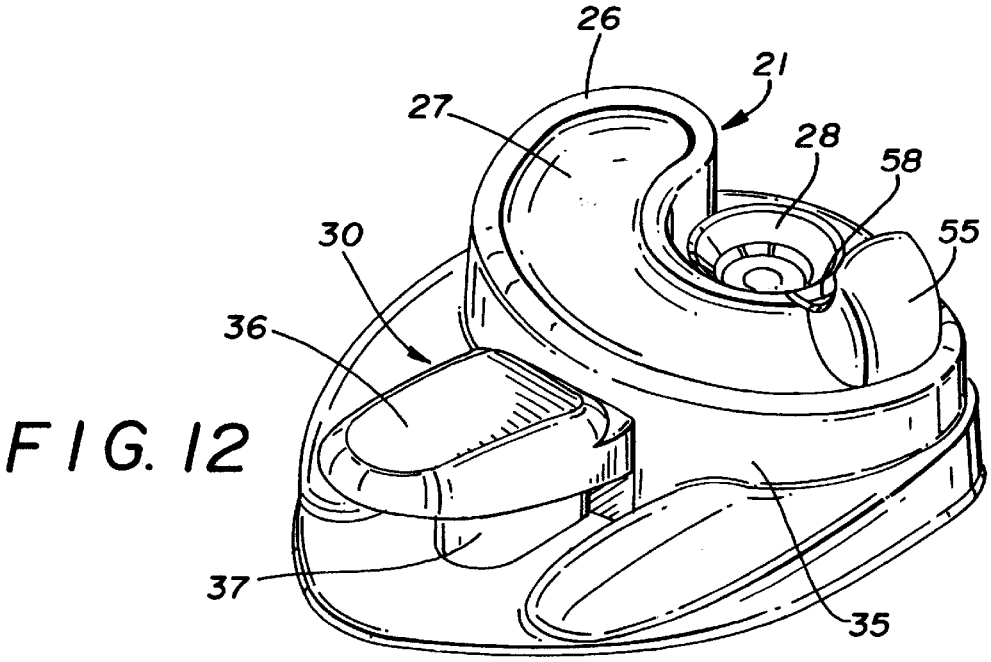
FIG. 12 is a perspective view of the device shown in FIG. 1 with the chute and tee removed, thus showing the device in the ball tossing mode.

A ball tossing or teeing device made in accordance with the concepts of the present invention is indicated generally by the numeral 20 in the accompanying drawings and is preferably made of a suitable, inexpensively molded, plastic material. The primary components of ball tossing or teeing device 20 include a base housing, generally indicated by the numeral 21, which houses an operating mechanism, generally indicated by the numeral 22 and shown in FIGS. 2–10; and a teeing assembly, generally indicated by the numeral 23, which includes a chute, generally indicated by the numeral 24, and a tee generally indicated by the numeral 25. As will hereinafter be described in more detail, when device 20 is used in a tossing mode, teeing assembly 23 may be removed from housing 21 as shown in FIG. 12. FIGS. 1, 2 and 11 show device 20 in the teeing mode with assembly 23 being attached to housing 21. In either mode, operating mechanism 22 serves to either launch a ball or to automatically position a ball on tee 25.

Base housing 21 includes a ball feeding magazine 26 formed near the top thereof. Magazine 26 includes an arcuate bottom surface 27 which slopes downwardly toward a dished out ball launch pad 28 formed adjacent to the end of magazine 26. Magazine 26 is designed to carry a plurality of balls B which can be of any type such as conventional baseballs, tennis balls, or most preferably the traditional plastic ball used for practice purposes.

Operating mechanism 22 includes a pedal, generally indicated by the numeral 30, which has a tab 31 extending downwardly from near the center thereof which is pin connected, as at 32, to a tab 33 extending upwardly from the bottom surface 34 of housing 21. Pedal 30 thus pivots on pin 32. Pedal 30 extends outwardly through a side wall 35 of magazine 26 and a foot-receiving surface 36 is formed at the outer end thereof. Pedal 30 is thus depressible over a guide housing 37 positioned therebelow. As would be evident to one skilled in the art, the underside of foot-receiving surface 36 may be formed to generally match the configuration of guide housing 37 so that as pedal 30 is depressed, cocking thereof is avoided.

Figure 3:
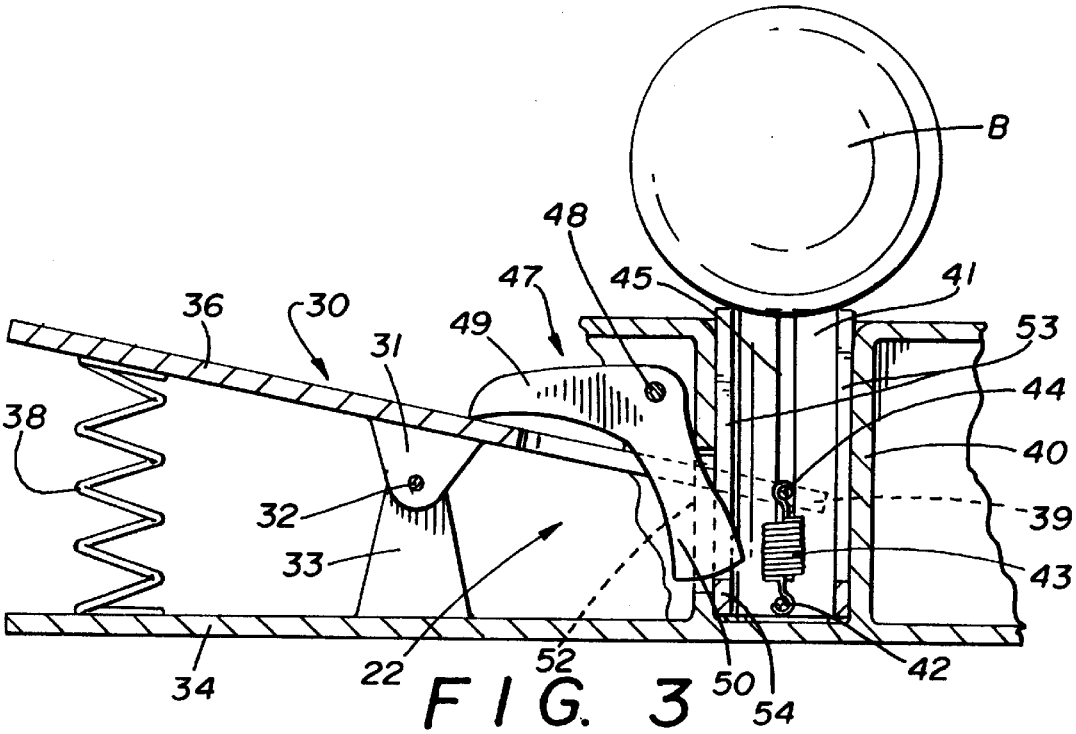
FIG. 3 is a somewhat schematic, fragmented, sectional representation of the operating mechanism for the ball tossing and teeing device as viewed in FIG. 2.

A coil spring 38 is carried within housing 37 and is affixed in a conventional manner at one end to bottom surface 34 of housing 21, with its other end extending upwardly through the top of housing 37 and being connected to the bottom of pedal 30 below surface 36. Spring 38 thus normally maintains pedal surface 36 away from bottom surface 34 of housing 21 as shown in FIG. 3.

As best shown in FIGS. 7–10, the inner end of pedal 30 is bifurcated to form spaced tongs 39 which extend around a well 40 formed in housing 21 below launch pad 28. Well 40 receives a launch tube 41 which is adapted to move upwardly through launch pad 28 to strike a ball B to propel the same. A pin 42 extends across the bottom of tube 41 and a power spring 43 within tube 41 has one end connected to pin 42. The other end of spring 43 is connected to a pin 44 which extends between tongs 39 of pedal 30. Pin 44 is received through, and is vertically movable within, diametrically opposed, axially extending slots 45 formed in tube 41. Mating slots 46 are also formed in well 40 with slots 45 being adapted to be aligned with slots 46 such that pin 44 also extends through slots 46.

A rocker plate, generally indicated by the numeral 47, is pin connected, as at 48, for pivotal movement within housing 21. Plate 47 includes arms 49 and 50 extending from the location of pin 48 at an angle somewhat in excess of 90 degrees. Plate 47 is positioned between the tongs 39 of pedal 30 and the outer end of its arm 49 rests against a sloped surface 51 (FIG. 2) formed in pedal 30 between its pivot pin 32 and the inner end of tongs 39. The outer end of the other arm 50 of plate 46 is positioned to be received through an axially extending slot 52 formed in well 40 and a mating axially extending slot 53 formed in tube 41. Slot 53 is preferably formed 90 degrees of slots 45 and, as shown, tube 41 can be formed with two diametrically opposed slots 53 for ease of assembly; that is, slots 45 and 53 thus become interchangeable when assembling device 10. Since slots 53 do not extend all the way to the bottom of tube 41, a ledge 54 is formed at that location, and the bottom edge of arm 49 normally bears against ledge 54.

Figure 7:
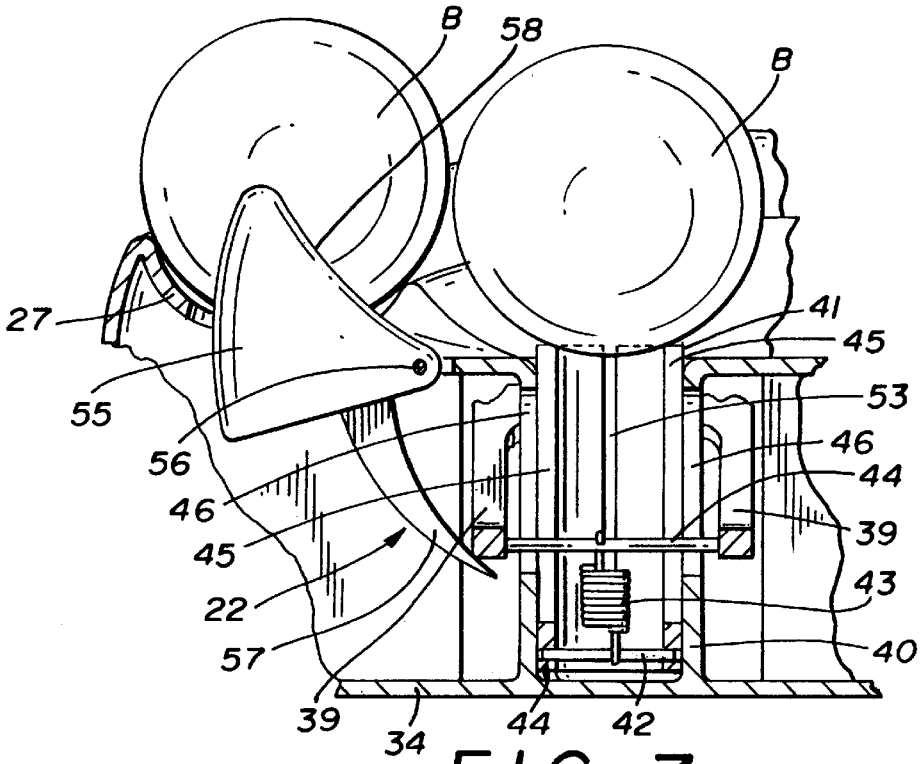
FIG. 7 is a somewhat schematic, fragmented, sectional view taken along line 7—7 of FIG. 1 and showing the operating mechanism in the same position as shown in FIG. 3.
Figure 8:
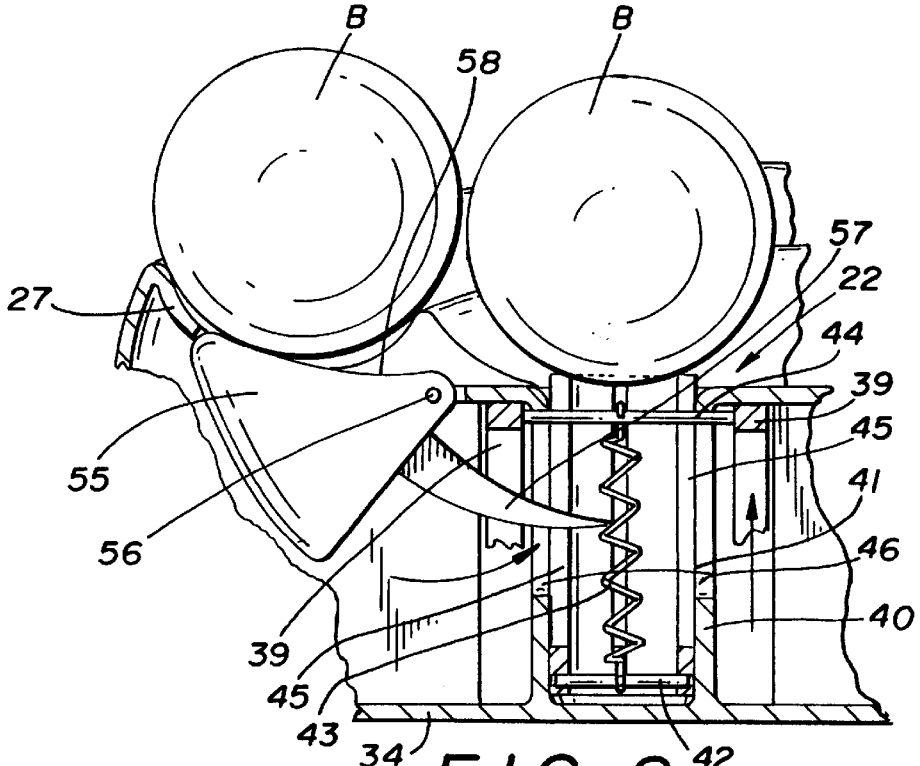
FIG. 8 is a somewhat schematic, fragmented, sectional view like FIG. 7 and sequentially following FIG. 7 in the operation of the device showing the operating mechanism in the same position as FIG. 4.
Figure 9:
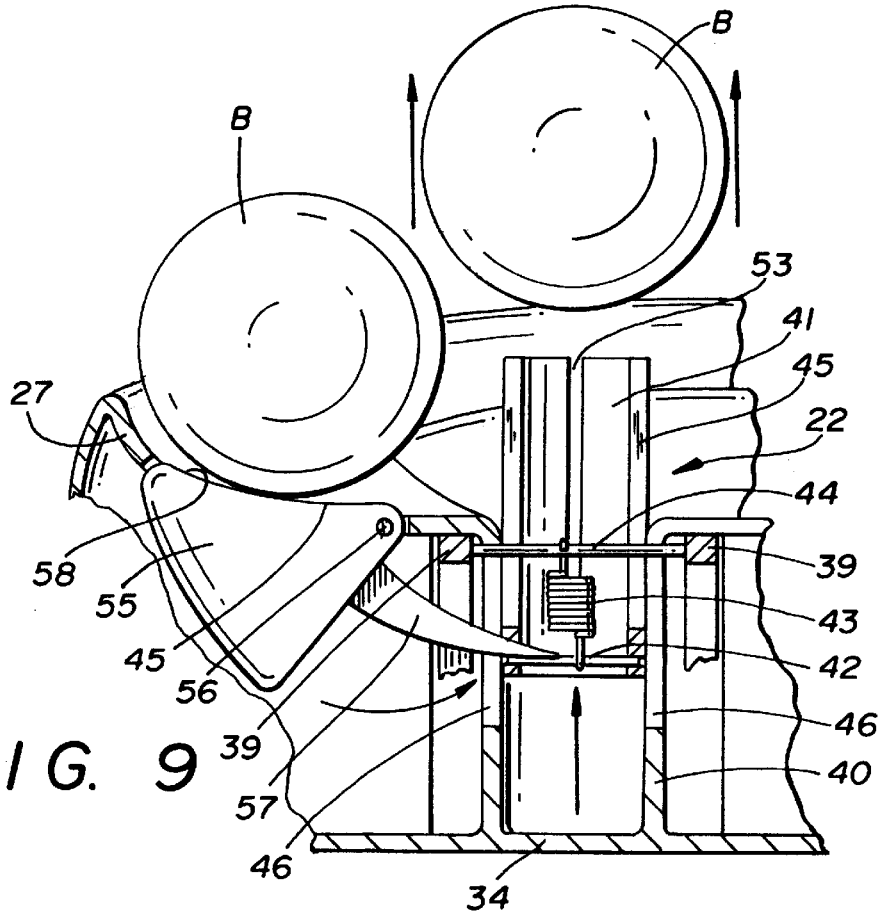
FIG. 9 is a somewhat schematic, fragmented, sectional view like FIG. 7 and sequentially following FIG. 8 in the operation of the device showing the operating mechanism in the same position as FIG. 5.

The structure of operating mechanism 22 which allows balls B to be fed to launch pad 28 one at a time is best described with reference to FIGS. 1 and 7–10. A blocking paddle 55 is pin connected, as at 56, to housing 21 and has arm 57 extending therefrom. As shown in FIG. 7, when pedal 30 is in the FIG. 3, unactivated position, the outer end of arm 57 is under a tong 39 of pedal 30 which thereby maintains paddle 55 in the up position as shown in FIGS. 1 and 7. In this position, paddle 55 is blocking the balls B in magazine 26 from rolling toward launch pad 28. When pedal 30 is depressed, as shown in FIG. 8, arm 57 is no longer being engaged by tong 39 and paddle 55 falls by gravity to permit the next ball B to roll onto the curved surface 58 of paddle 55 as shown in FIG. 9. Upon release of pedal 30, tong 39 re-engages arms 57 and paddle 55 is rotated to push the next ball B onto the launch pad 28 while at the same time blocking the next ball B as shown in FIG. 10. This action is thus coordinated with the overall ball launching operation, now to be described.

For ease of discussing the operation of device 10, it will be assumed that a plurality of balls B have been placed in magazine 26 and a ball B is already on launch pad 28 as shown in FIGS. 3 and 7. In this position, spring 38 is extended, power spring 43 is compressed, arm 50 of plate 47 is in slot 53 of launch tube 41, and paddle 55 is up preventing the next ball B from moving down sloped surface 27 of magazine 26. An initial depression of pedal 30 by engaging surface 36 with one's foot moves the components of operating mechanism 22 to the FIGS. 4 and 8 position. In this position, spring 38 has been compressed, but is not fully compressed. Power spring 43 is almost fully extended, as pin 44 moves in tube slot 45, but launch tube 41 is not able to move because plate 47, although it has been rotated somewhat clockwise by pedal 30, is still in slot 53 and engaging ledge 54 of tube 41. At this point, however, tong 39 of pedal 30 has moved away from arm 57 of paddle 55 and, as previously described, paddle 55 falls by gravity to the FIG. 8 position and the next ball B may begin rolling toward paddle 55. Operating mechanism 22 is now fully cocked.

Figure 4:
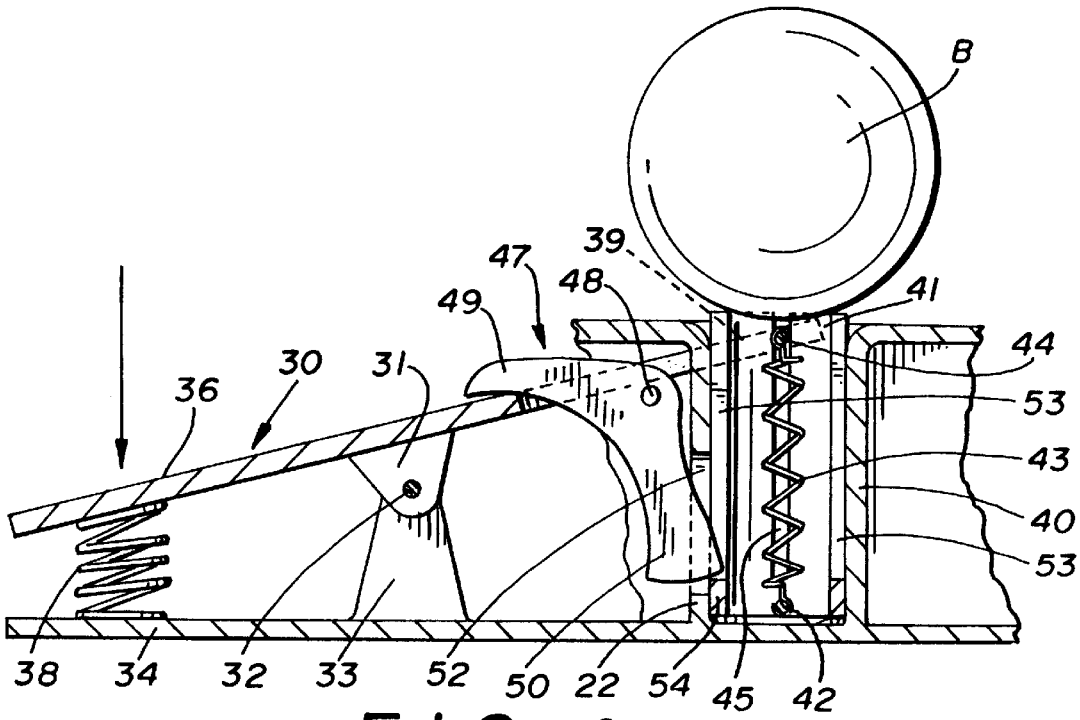
FIG. 4 is a somewhat schematic, fragmented, sectional representation like FIG. 3 and sequentially following FIG. 3 in the operation of the device.
Figure 5:
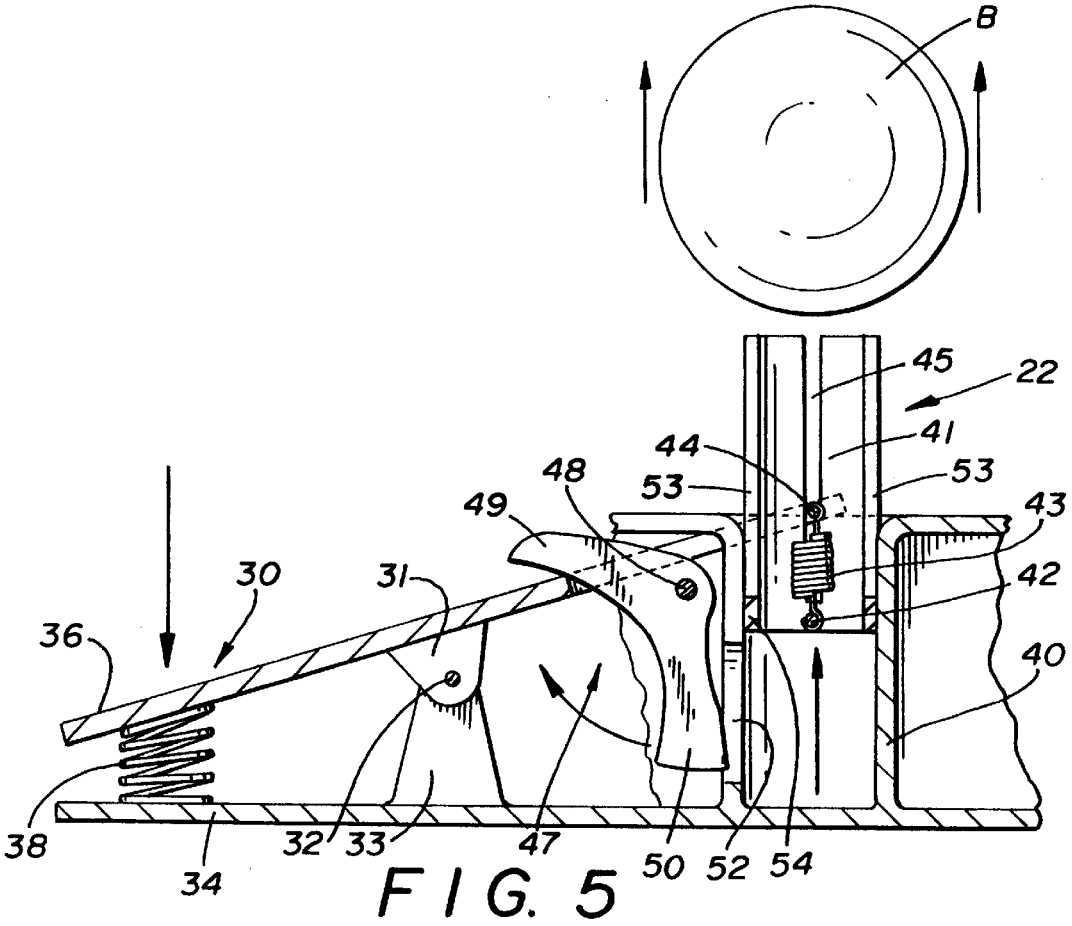
FIG. 5 is a somewhat schematic, fragmented, sectional representation like FIG. 3 and sequentially following FIG. 4 in the operation of the device.
Figure 6:
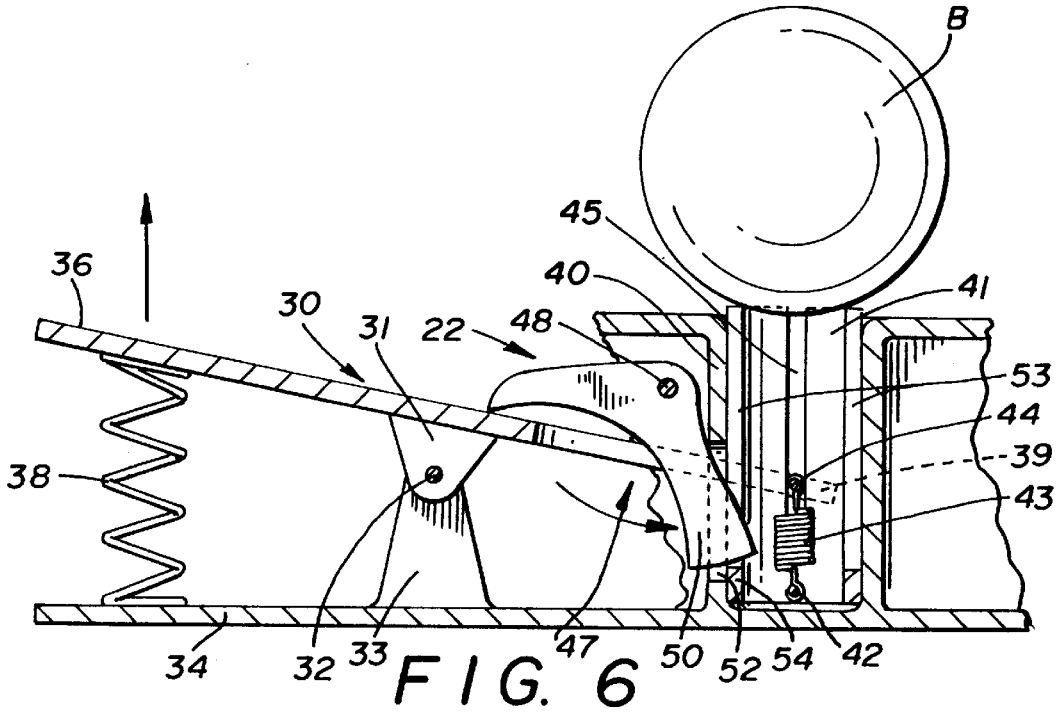
FIG. 6 is a somewhat schematic, fragmented, sectional representation like FIG. 3 and sequentially following FIG. 5 in the operation of the device.

A slight further depression of pedal 30, from the FIGS. 4 and 8 position to the FIGS. 5 and 9 position, further rotates plate 47 such that its arm 50 is no longer engaging ledge 54 and holding tube 41 down. As a result, tube 41 is released, and under the influence of spring 43 it moves upwardly to strike and project the ball B from pad 28. As previously described, by this time the next ball B is fully positioned on paddle surface 58 as shown in FIG. 9. Upon the release of pedal 30, under the influence of pedal spring 38, operating mechanism 22 moves to the FIGS. 6 and 10 position which is the initial position shown in FIGS. 3 and 7. In traveling from the FIG. 9 to the FIG. 10 position, tong 39 of pedal 30 re-engages arm 57 of paddle 55 to raise paddle 55 to push the ball positioned on surface 58 onto launch pad 28 while at the same time blocking the next ball B in magazine 26. The foot pedal 30 may thus again be depressed and operating mechanism 22 will go through the same sequence to project the ball B now positioned on pad 28.

It should thus be appreciated that one complete depression and release of pedal 30 essentially instantaneously cocks operating mechanism 22, releases the next ball B, and projects the ball B currently on the launch pad 28 after which the next ball B is put into launching position upon release of pedal 30. If device 20 is in the tossing mode shown in FIG. 12, that is, with teeing assembly 23 removed from housing 21, the ball B will be tossed into the air for the user to swing at with a bat. However, the same operating mechanism 22 and its sequence of operation can also be utilized in the teeing mode of device 20, now to be described.

Chute 24 of teeing assembly 23 is a hollow, cylindrical member which can be conveniently molded from two halves which can be snapped together, as at 60, by any conventional method known in the art. Chute 24 may also be provided with windows 61 which not only reduce the cost to make the part but also provide a visual observation of a ball B as it moves up chute 24 in the teeing mode of operation of device 20. As best shown in FIGS. 1 and 2, the bottom of chute 24 is provided with an opening 62 so as to provide access to launch pad 28 and to thereby allow a ball B to be received through opening 62 and onto pad 28 below chute 24. Chute 24 may be attached to housing 21 by a plurality of tabs 63 which may be snapped into housing 21 at the periphery of launch pad 28.

Teeing assembly 23 also includes tee 25 which is carried at the top of chute 24. Tee 25 includes a collar 64 having an upper hood 65 opposed to a bottom access opening 66 which communicates with the top opening of chute 24. Hooded collar 64 also has a lateral opening 67, and a downwardly sloped tee arm 68 having an upwardly concave surface extends outwardly from opening 67 and terminates at a distal hitting station which includes a support receptacle in the form of a ball-teeing cup 69. Hood access opening 67 is somewhat restricted by a pair of flexible tabs 70, 71 which extend inwardly over opening 67.

When device 20 is to be used in the teeing mode, chute 24 is merely snapped into place on housing 21 as shown in FIGS. 1 and 2. Then operating mechanism 22 is operated as previously described and a ball B is projected up chute 24. Its acceleration is impeded by the interference of tabs 70 and 71 which flex to allow the ball to pass thereby, and once the ball B has passed tabs 70 and 71, they prohibit it from falling back down chute 24. Rather, the ball will roll through lateral opening 67, will roll by gravity on the concave surface of arm 68, and will roll onto cup 39 thereby terminating its movement. Cup 39 supports only a minor portion of the periphery of the bottom of ball B so that a substantial surface of ball B remains exposed. From that position the user may hit the ball off of cup 69 of tee 35 and thereafter actuate operating mechanism 22 to position the next ball B on cup 69.

As shown in FIG. 11, device 20 may be employed in a different teeing mode. For example, by simply rotating tee 25 on chute 24 180 degrees or by snapping chute 24 into housing 21 in the opposite direction to that shown in FIG. 1, instead of being generally over pedal 30 and on the same side of housing 21 as pedal 30, arm 68 may extend in the other direction and be on the opposite side of housing 21 from pedal 30. In this FIG. 11 configuration, one person may activate operating mechanism 22 by depressing pedal 30 while another person, standing on the opposite side of housing 21, may bat the ball off of tee cup 69. Such may be particularly useful for very young children who may not be able to activate operating mechanism 22 on their own.

In view of the foregoing, it should thus be evident that a ball tossing or teeing device constructed as described herein accomplishes the objects of the present invention and otherwise substantially improves the art.

What is claimed is:

1. Apparatus for launching balls comprising a housing, and an operating mechanism in said housing, said operating mechanism including a pedal extending out of said housing and depressible to actuate said operating mechanism such that upon a single depression and release of said pedal, said operating mechanism is activated to launch a ball and to position another ball in place on said housing for launching.

2. Apparatus according to claim 1 wherein said housing includes a launch pad and a magazine capable of carrying a plurality of balls, said operating mechanism feeding balls one at a time from said magazine to said launch pad.

3. Apparatus according to claim 2 wherein said operating mechanism includes a blocking paddle pivotal from a first position preventing a ball in said magazine from moving to said launch pad to a second position to receive a ball to be transferred to said launch pad.

4. Apparatus according to claim 3 wherein said blocking paddle includes an arm engageable by said pedal such that upon depression of said pedal said blocking paddle moves from said first position to said second position and upon release of said pedal said blocking paddle moves from said second position to said first position.

5. Apparatus according to claim 1 wherein said operating mechanism includes a launch tube and a spring connected between said pedal and said launch tube such that upon depression of said pedal said spring moves said launch tube to launch a ball.

6. Apparatus according to claim 5 wherein said operating mechanism further includes a pin connecting said pedal to said spring, said launch tube having slots therein, said pin being movable in said slots as said spring is being extended to cock said operating mechanism.

7. Apparatus according to claim 6 wherein said operating mechanism further includes a pivotal rocker plate having first and second arms, said first arm resting on said pedal and said second arm engaging said launch tube and preventing said launch tube from moving until said operating mechanism is cocked such that upon complete depression of said pedal said second arm disengages said launch tube.

8. Apparatus according to claim 1 further comprising a teeing assembly, said teeing assembly including a chute removably attachable to said housing, and a tee carried by said chute, such that upon activation of said operating mechanism with said chute attached to said housing, a ball will move up said chute and onto said tee.

9. Apparatus according to claim 8 wherein said teeing assembly includes means to prevent the ball from dropping down said chute to assure that the ball moves onto said tee.

10. Apparatus for tossing or teeing balls comprising a housing, an operating mechanism in said housing which upon activation can toss a ball into the air, a chute removably attachable to said housing, and a teeing assembly carried at the top of said chute, such that upon activation of said operating mechanism with said chute attached to said housing, the ball will move up said chute and onto said teeing assembly.

11. Apparatus according to claim 10 wherein said chute has an open top and said teeing assembly includes a hood over said open top.

12. Apparatus according to claim 11 wherein said teeing assembly includes means to prevent the ball from dropping down through said open top.

13. Apparatus according to claim 12 wherein said means includes at least one flexible tab flexing to permit the ball to pass upwardly toward said hood but preventing the ball from dropping downwardly through said open top.

14. Apparatus according to claim 10 wherein said teeing assembly includes a sloped arm positioned adjacent to the top of said chute, and a cup carried by said arm, the ball moving on said arm to said cup.

15. Apparatus according to claim 10 wherein said teeing assembly includes an arm for receiving the ball and directing the ball therealong to a distal hitting station wherein the ball is supported by said arm in a stationary position.

16. Apparatus according to claim 15 wherein said arm slopes downwardly from said chute to the hitting station under the influence of gravity.

17. Apparatus according to claim 16 wherein said arm includes an upwardly concave surface extending from said chute to the hitting station.

18. Apparatus according to claim 16 further comprising receptacle means at the hitting station for terminating movement of the ball along said arm and maintaining the ball in a stationary position.

19. Apparatus according to claim 18 wherein said receptacle means supports a bottom surface portion of the ball, thereby leaving a substantial remaining surface portion of the ball exposed for hitting.

20. Apparatus according to claim 10 wherein said operating mechanism includes a pedal extending laterally outwardly of said housing, said pedal being depressible to actuate said operating mechanism, said teeing assembly being selectively positionable to extend laterally from said chute in generally the same direction as said pedal or to extend laterally from said chute in generally the opposite direction of said pedal.

21. Apparatus according to claim 10 wherein said operating mechanism includes a pedal extending out of said housing and depressible to actuate said operating mechanism such that upon depression of said pedal, said operating mechanism moves the ball up said chute.

22. Apparatus according to claim 21 wherein said housing includes a launch pad positioned below said chute and a magazine capable of carrying a plurality of balls, said operating mechanism including means to feed one ball at a time to said launch pad upon release of said pedal.

23. Apparatus according to claim 22 wherein said means includes a blocking paddle pivotal from a first position preventing a ball in said magazine from moving to said launch pad to a second position to receive a ball to be transferred to said launch pad.

24. Apparatus according to claim 23 wherein said blocking paddle includes an arm engageable by said pedal such that upon depression of said pedal said blocking paddle moves from said first position to said second position and upon release of said pedal said blocking paddle moves from said second position to said first position.

25. Apparatus according to claim 10 wherein said operating mechanism includes a pedal to actuate said operating mechanism, a launch tube, and a spring connected between said pedal and said launch tube such that upon depression of said pedal, said spring moves said launch tube to move the ball up said chute.

26. Apparatus according to claim 25 wherein said operating mechanism further includes a pin connecting said pedal to said spring, said launch tube having slots therein, said pin being movable in said slots as said spring is being extended to cock said operating mechanism.

27. Apparatus according to claim 26 wherein said operating mechanism further includes a pivotal rocker plate having first and second arms, said first arm resting on said pedal and said second arm engaging said launch tube and preventing said launch tube from moving until said operating mechanism is cocked such that upon complete depression of said pedal said second arm disengages said launch tube.

28. Apparatus for tossing or teeing balls comprising a housing; an operating mechanism in said housing; said operating mechanism including a pedal extending out of said housing and depressible to actuate said operating mechanism such that upon a single depression of said pedal, said operating mechanism is actuated to, in one mode, launch a ball; a chute removably attachable to said housing; and a teeing assembly carried at the top of said chute; such that in another mode with said chute attached to said housing, upon activation of said operating mechanism the ball will move up said chute and onto said teeing assembly.

29. Apparatus according to claim 28 wherein said operating mechanism includes means to position another ball in place on said housing for tossing upon release of said pedal.

* * * * *